United States Patent [19]

Resendez, Jr. et al.

[11] Patent Number: 4,991,416

[45] Date of Patent: Feb. 12, 1991

[54] LOCK FOR RELEASABLY SECURING TWO CLOSEABLE ELEMENTS

[76] Inventors: Henry Resendez, Jr., 5358 N. Forkner, Fresno, Calif. 93711; Helmut Klein, Heidekamp 51, D-5620 Velbert 1, Fed. Rep. of Germany

[21] Appl. No.: 426,716

[22] Filed: Oct. 26, 1989

[51] Int. Cl.[5] ..... E05B 37/02

[52] U.S. Cl. ..... 70/312; 70/84; 70/115; 70/126

[58] Field of Search ..... 292/DIG. 4, 111; 70/312, 158–162, 78, 79, 80, 81, 82, 83, 84, 114, 115, 125, 126, 121, 122, 133, 130

[56] References Cited

U.S. PATENT DOCUMENTS 3,633,388 1/1972 Atkinson ..... 70/312

4,383,707 5/1983 Nishimura ..... 292/DIG. 4

4,660,871 4/1987 Arakawa ..... 292/DIG. 4

4,792,165 12/1988 Nishimura ..... 292/DIG. 4

*Primary Examiner*—Robert L. Wolfe

*Attorney, Agent, or Firm*—Shapiro and Shapiro

[57] ABSTRACT

A lock for cabinets wherein a lock component is attached to one element of the cabinet and a counter-locking component is attached to another element. The lock component includes a hook-shaped latching bolt which is slidable and swivelable to become engaged with and disengaged from the counter-locking component. The latching bolt is held in a latching position by a locking bolt part of a permutation lock, and also by a retaining mechanism in the form of a heart-shaped endless cam slot which effects a release of the latching bolt only in response to a displacement of the latter in a door-closing direction.

26 Claims, 12 Drawing Sheets

LOCK FOR RELEASABLY SECURING TWO CLOSEABLE ELEMENTS

BACKGROUND AND OBJECTS OF THE INVENTION

The invention relates to a lock and especially to a lock for cabinets in which a counter-locking component mounted on a door or a cabinet base is latched by a lock component mounted on the other of the door and base.

Locks of this type are most advantageously used for cabinets of the type which accommodate a record player, video cassette recorder, video tape, and the like, in order to protect them, e.g., for protection from children. Opening of the door protected by the lock is carried out by actuating the lock with one hand while opening the door with the other hand.

An object of this invention is to simplify as much as possible the steps of unlocking, opening and the closing of the door.

SUMMARY OF THE INVENTION

The present invention involves a lock for a closable member comprising first and second relatively moveable elements. The lock comprises a lock component adapted to be mounted to one of the elements and a counter-locking component adapted to be connected to the other of the elements. The lock component comprises a housing having an opening, and a latching bolt slidably mounted in the opening. The latching bolt includes a rear end disposed in the housing and a hook-shaped front end disposed outside of the housing. The latching bolt is slidable rearwardly by the counter-locking component to a latching position in response to the closing of the other element, wherein the hook-shaped end is placed in latching engagement with the counter-locking component. The latching bolt is also slidable forwardly to an unlatching position. Structure is provided for swiveling the latching bolt in one direction during rearward sliding movement thereof to effect the latching engagement with the counter-locking component. Structure is also provided for swiveling the latching bolt in an opposite direction during forward sliding movement thereof to effect the unlatching. A locking bolt is provided for releasably engaging the latching bolt in the latching position.

Preferably, a retaining structure, such as a cam slot, is provided for preventing forward movement of the latching bolt out of its latching position. The latching bolt is releasable from the retaining structure in response to rearward movement of the latching bolt.

Preferably, the retaining structure comprises an endless cam slot carried by one of the latching bolt and the housing, and a pin carried by the other of the latching bolt and housing and received in the cam slot.

BRIEF DESCRIPTION OF THE DRAWINGS

The objects and advantages of the invention will become apparent from the following detailed description of preferred embodiments thereof in connection with the accompanying drawings in which like numerals designate like elements, and in which.

DETAILED DESCRIPTION OF PREFERRED EMBODIMENTS OF THE INVENTION

Figure 1:
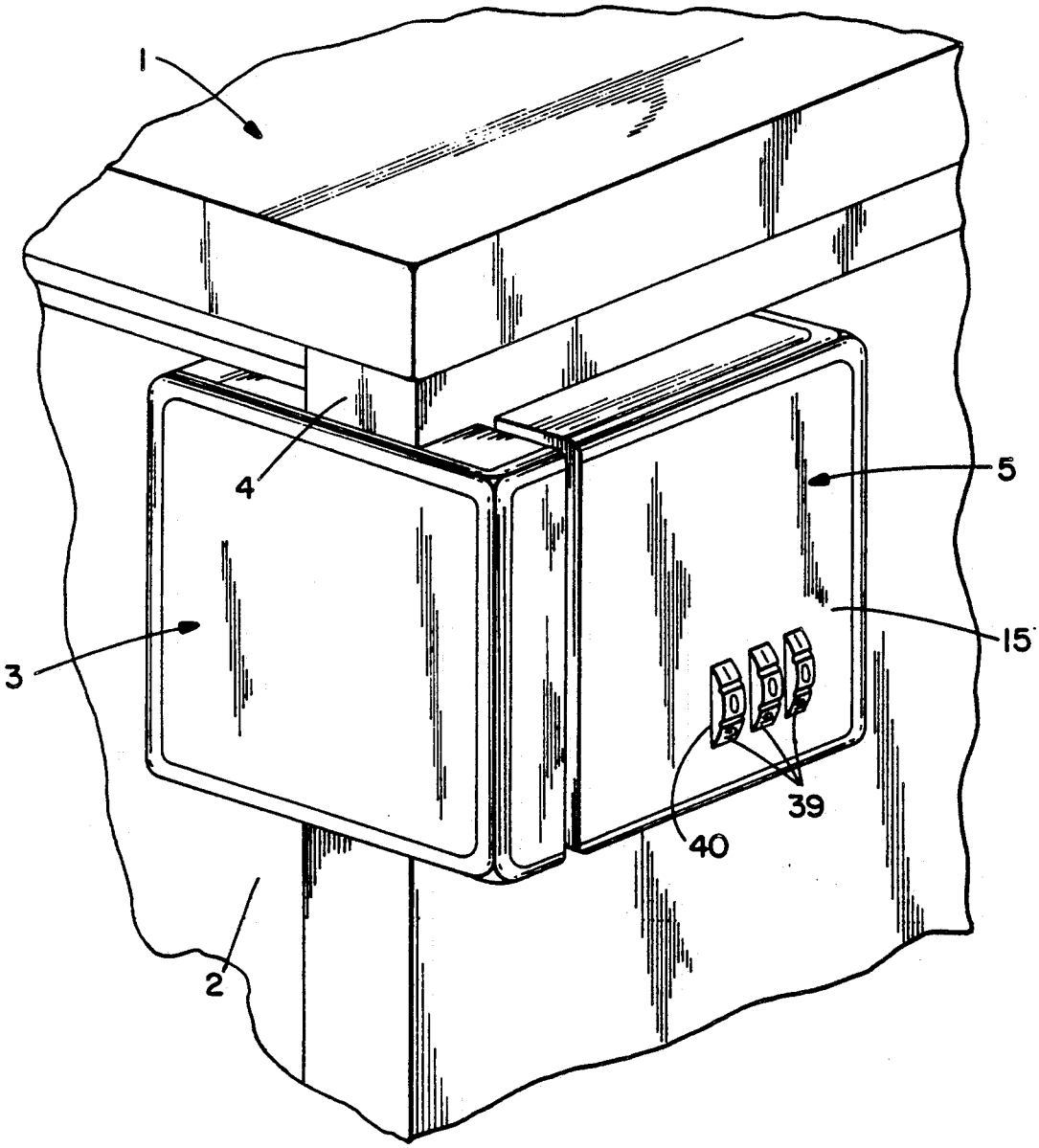
FIG. 1 a perspective view of a portion of a cabinet, depicting a locking mechanism in a locked condition.
Figure 2:
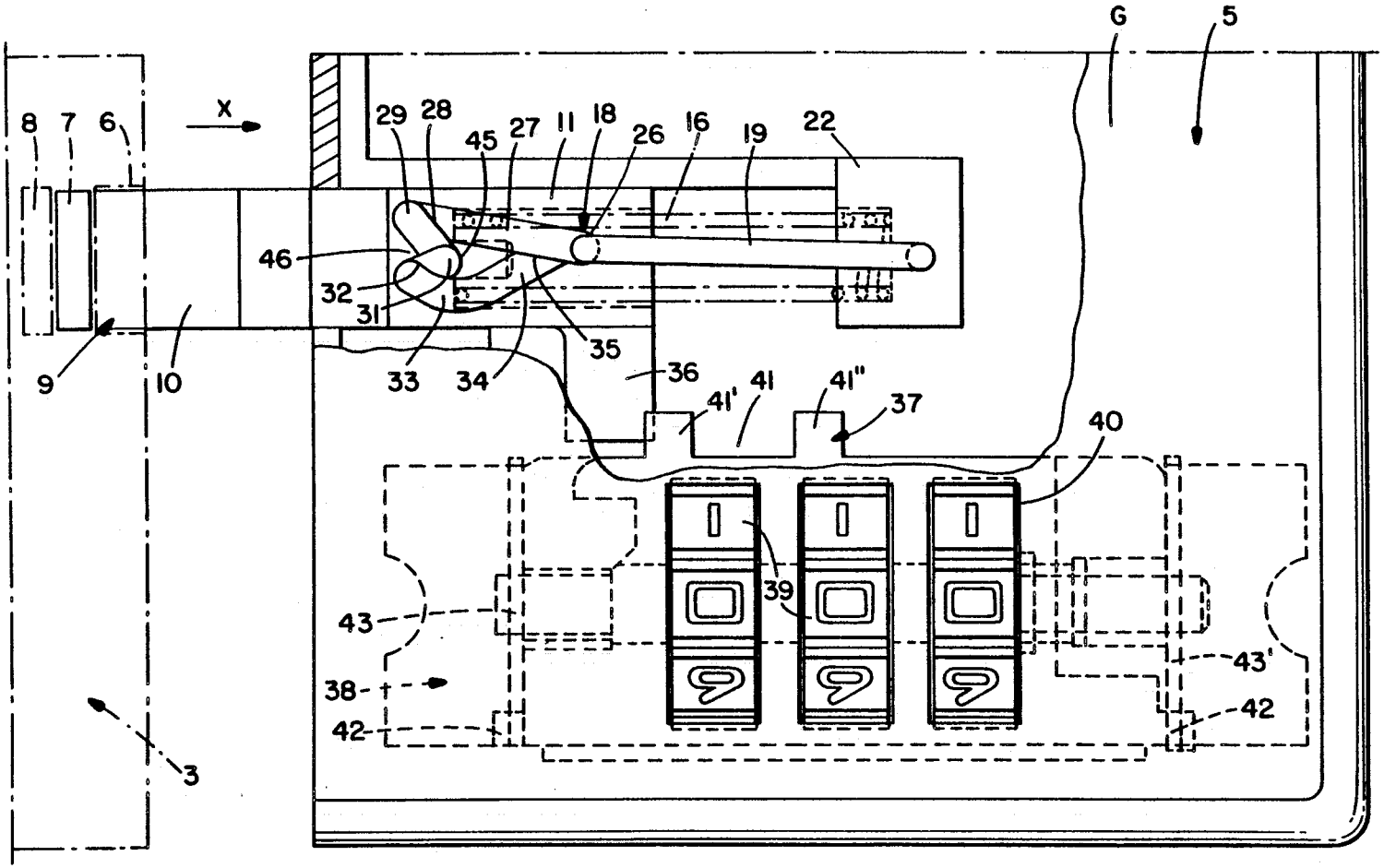
FIG. 2 is a side elevational view of the locking mechanism, with a portion of the locking housing removed to depict a latching bolt in an unlatching condition relative to a counter locking component depicted in phantom.
Figure 3:
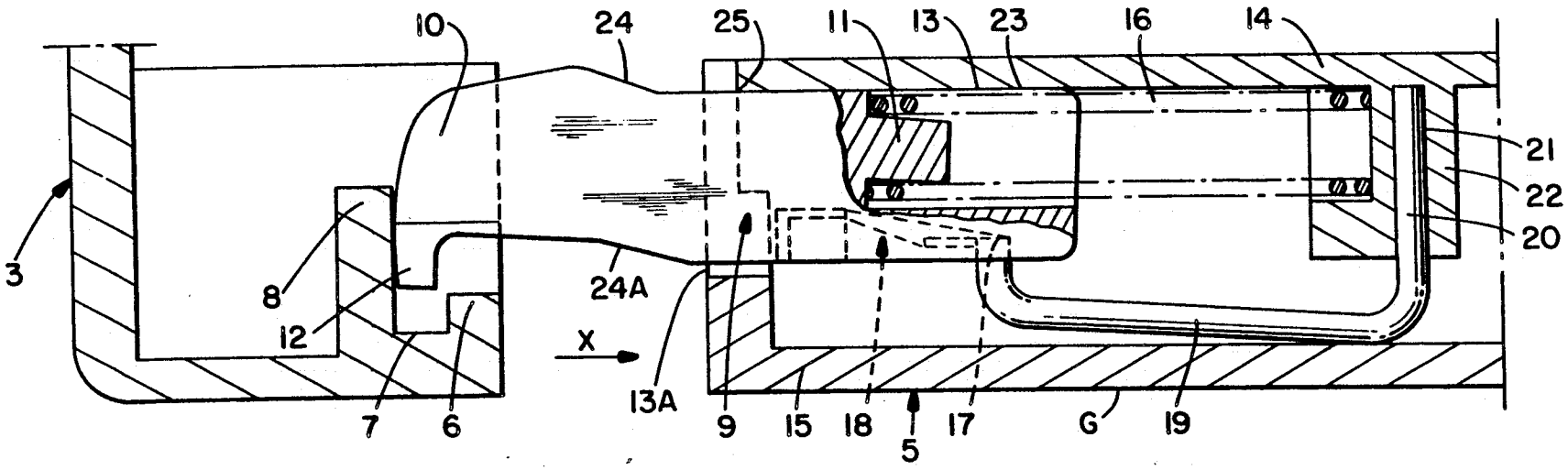
FIG. 3 is a horizontal sectional view taken through the locking mechanism, depicting the latching bolt in an unlatching position.
Figure 4:
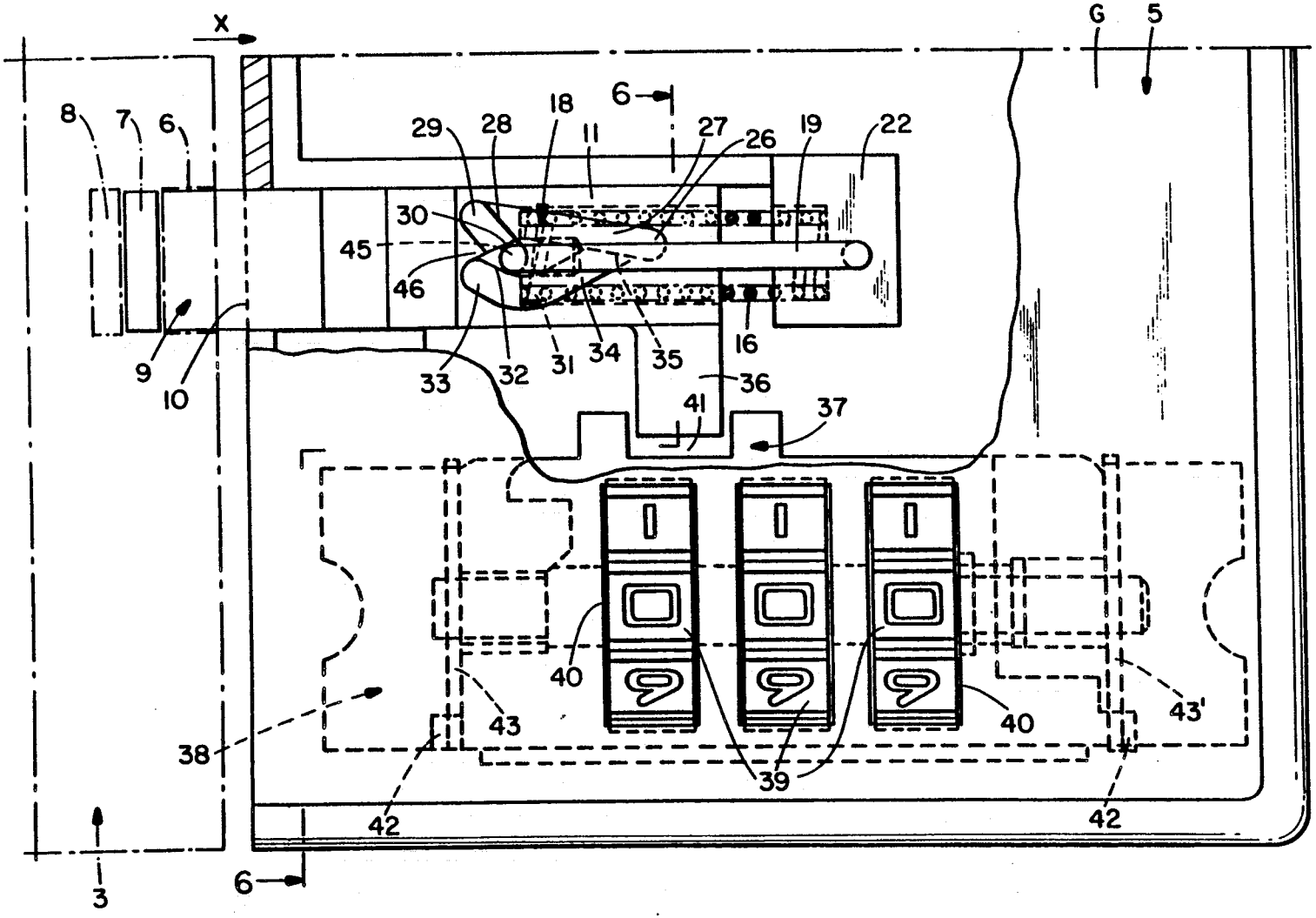
FIG. 4 is a view similar to FIG. 2 depicting the latching bolt in a latching position, and depicting a locking bolt in a locking position.

Depicted in FIG. 1 is a corner section of a piece of furniture such as a cabinet 1 used as an entertainment center. The cabinet 1 is particularly suitable to accommodate a record player, video cassette recorder, and the like. A door 2 of the cabinet can be designed as a glass door. The right-hand upper edge of the door is equipped with a counter-locking component 3 which cooperates with a lock 5 located on the outside of a cabinet side wall 4.

An end of the counter-locking component 3 faces the lock 5 and is equipped with a horizontally projecting catch portion 6 and an actuating tab 8 which together define a recess 7. The projecting catch portion 6 and the actuating tab 8, according to a first embodiment of the lock shown in FIGS. 1 through 7, cooperate with a hook-shaped latching bolt 9 of the lock 5. This hook-shaped latching bolt 9 includes a latching bolt head 10 protruding from a lock housing G as well as a tail piece 11 situated adjacent to the head 10 and extending into the housing. The latching bolt 9 is hook-shaped at its front end 12 and engages in the recess 7 of the counter-locking component 3 when the door 2 is closed (see FIG. 5).

The tail piece 11 of the latching bolt slides horizontally in a guide groove 13 of the lock housing G, the housing G comprising a base plate 14 and a cover 15. The front end 12 projects forwardly beyond an opening 13A of the guide groove. A pressure coil spring 16 acts on the back of the tail 11 to bias the latching bolt 9 in an outward or forward direction, i.e., toward the counter-locking component 3. The amount of outward displacement is limited by a pin 17 which is engaged in a continuous or endless cam slot 18 formed in a front side of the tail piece 11. The pin 17 comprises an angled front end section of a spring wire 19. The cover 15 supports a rear end of the spring wire 19 which comprises an angled wire end piece 20 in order to create a necessary preload of the pin 17. This wire end piece 20 runs parallel to the pin 17 and is supported in a locating hole 21 formed in the lock housing. This hole is located in a protrusion 22 of the base plate 14 which also supports the end of pressure spring 16.

A side surface 23 of the latching bolt 9 disposed opposite the side carrying the cam slot 18 is equipped with a position control slope 24 which cooperates with a side surface 25-of the guide groove 13 to laterally displace the latching bolt.

The endless cam slot 18 is designed in a heart shape in such a way that the tip 26 of the heart points rearwardly, i.e., in direction X. The heart-shaped cam slot 18 includes an upper or first side section 27 which extends forwardly and upwardly from the tip 26 and which joins an upper or first half section 29 of a head of the heart. The upper half section 29 extends rearwardly from a front end of the first side section 27 to form a corner therewith at which a step 28 is formed (see FIG. 7). A lower or second half section 31 of the head of the heart extends forwardly from a rear end of the upper half section 29, forming a corner therewith at which a step 30 is provided. The lower half section 31 joins a front end of a lower or second side section 33, forming a corner therewith at which a step 32 is provided. The lower side section 33 extends rearwardly and upwardly toward the tip 26 and joins the rear end of the upper side section 27 to form therewith a corner at which a step 35 is provided. As will be explained later, the steps 28, 30, 32, 35 are arranged to assure that the pin 17 can travel in only one direction relative to the cam slot, i.e., a direction in which the pin travels down the steps (as opposed to traveling up the steps). In other words, if the pin 17 is disposed at the tip 26, it can only travel forwardly along the upper side section 27, rather than along the lower side section 33.

When the hook 12 of the latching bolt 9 is disposed in a release or non-latching position, the pin 17 will be situated in the tip 26 of the cam slot.

The latching bolt 9 is equipped with an integral transverse projection 36 on the tail piece 11. This projection 36 cooperates With a rocker type catch of a locking bolt 37 of a conventional permutation lock 38 located in the lock housing G. The latter is equipped with three setting dials 39 with numeral type figures inscribed thereon. The dials protrude through slots 40 of cover 15. If the combination code is set correctly by means of the setting dials 39, then the catch of the locking bolt 37, which is equipped with an insertion opening 41 formed by two lugs 41', 41" is situated outside of the path of motion of the projection 36. If the combination setting of any dial is changed, the catch of the locking bolt 37, which is designed as a conventional rocker bolt, captures the projection 36. The catch of the locking bolt 37 is equipped with pinot tabs 42 at the edge opposite to the insertion opening 41, which tabs are supported in side walls 43, 43' of the permutation lock 38. Pressure springs 44 act upon an edge of the locking bolt 37-located opposite the opening 41. The springs 44 apply a load on the locking bolt directed toward the axis of the setting dials.

Figure 6:
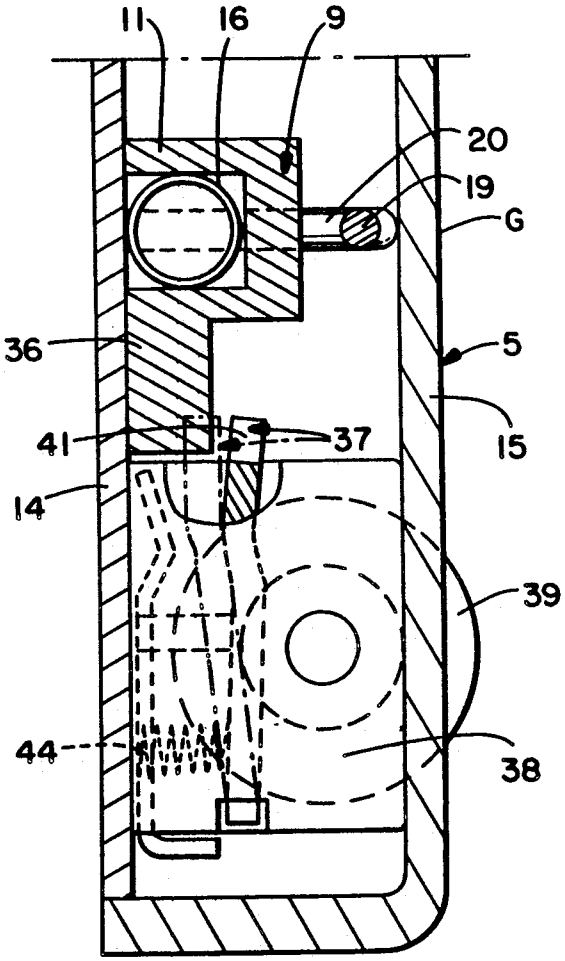
FIG. 6 is a cross-sectional view taken along the line 6—6 in FIG. 4.
Figure 8:
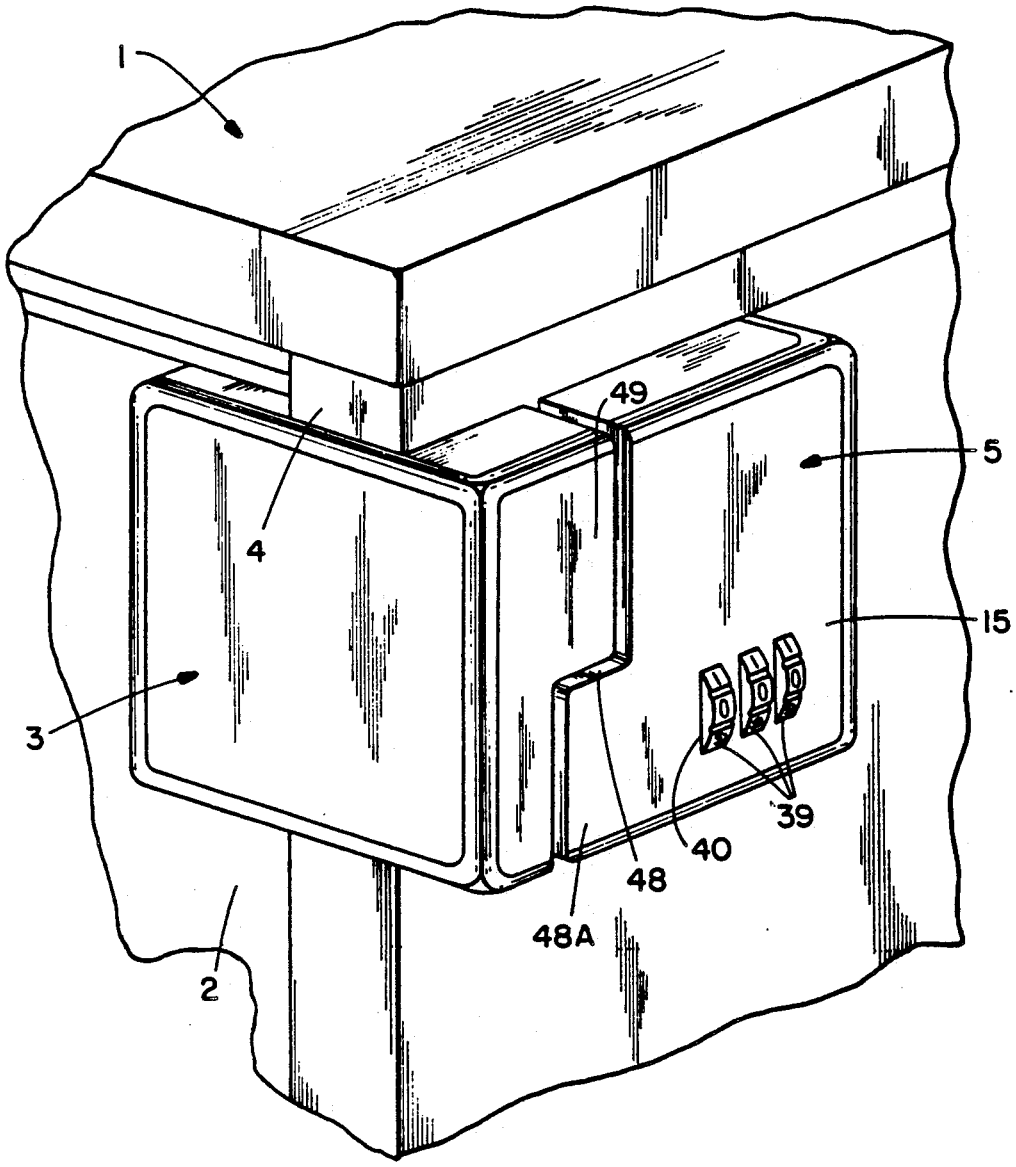
FIG. 8 is a view similar to FIG. 1 of a second embodiment of the invention.
Figure 9:
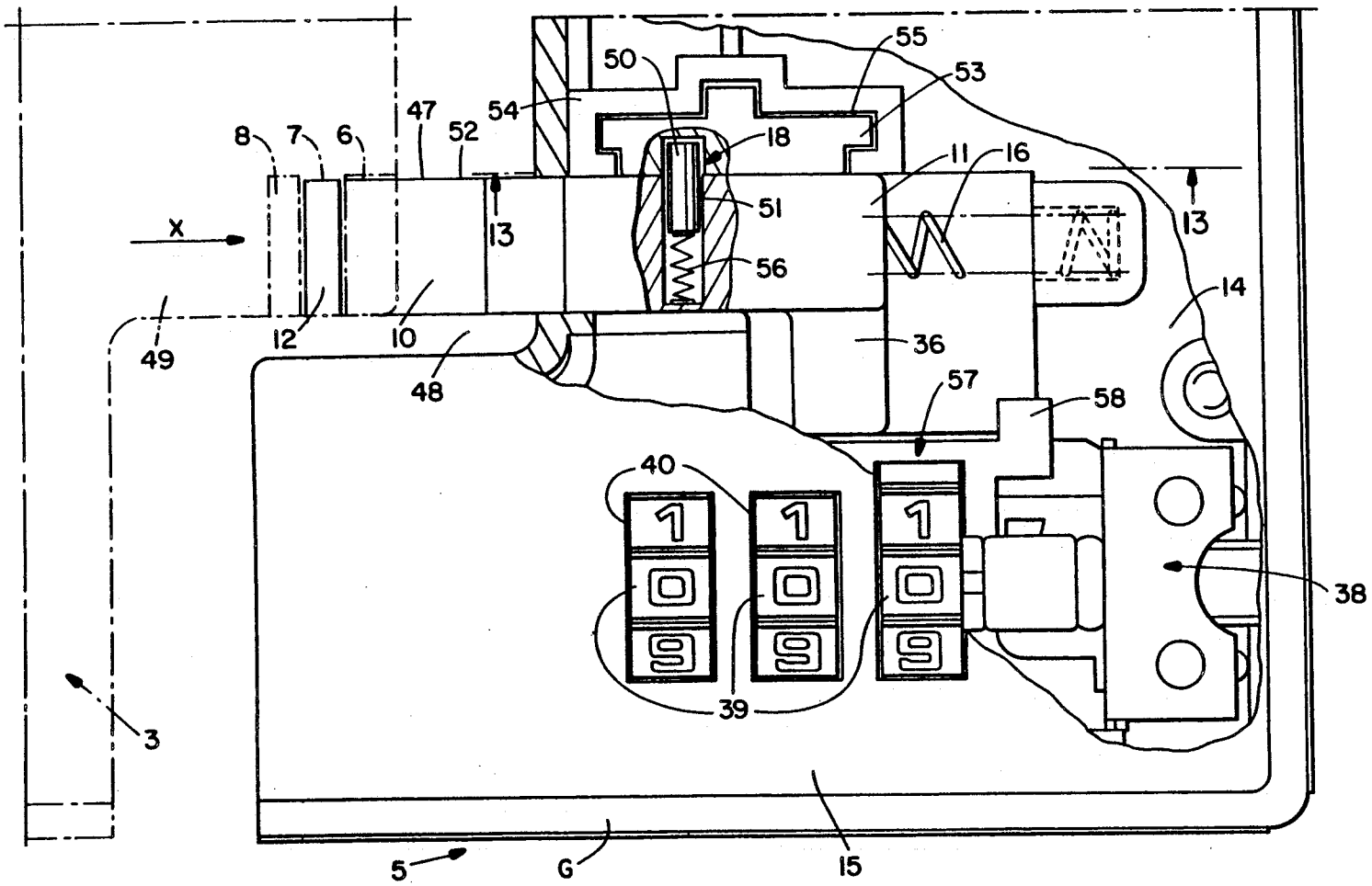
FIG. 9 is a view similar to FIG. 2 of the second embodiment.
Figure 10:
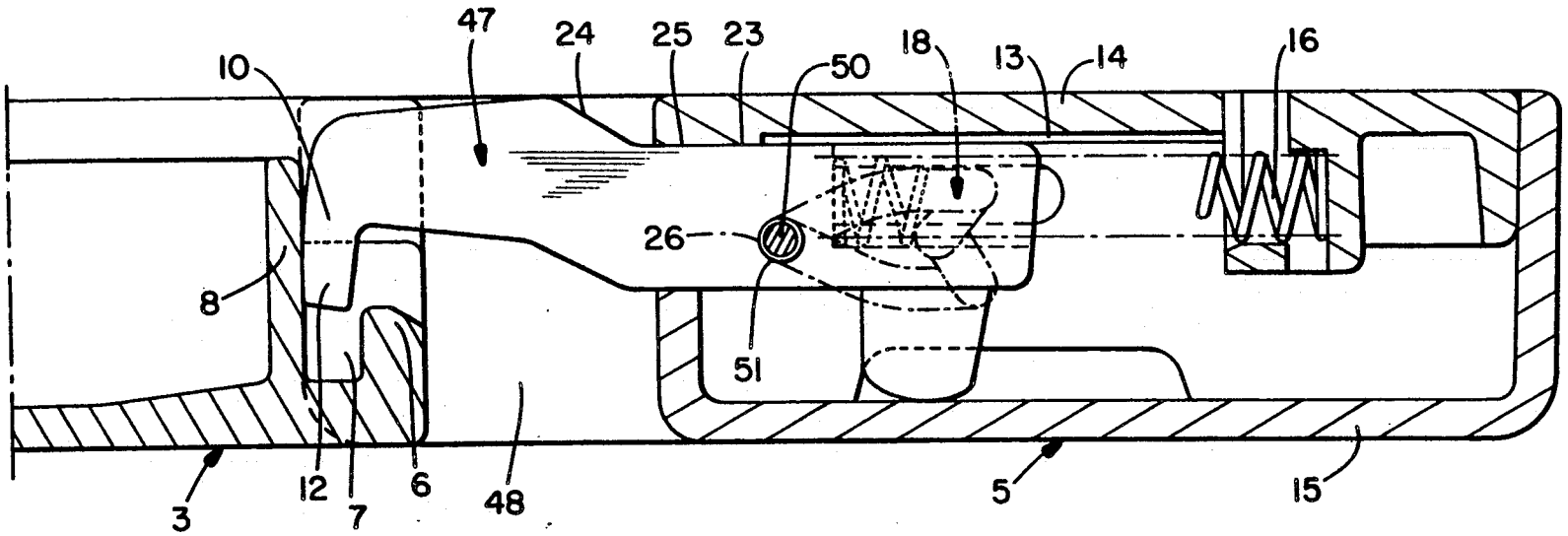
FIG. 10 is a view similar to FIG. 3 of the second embodiment.
Figure 11:
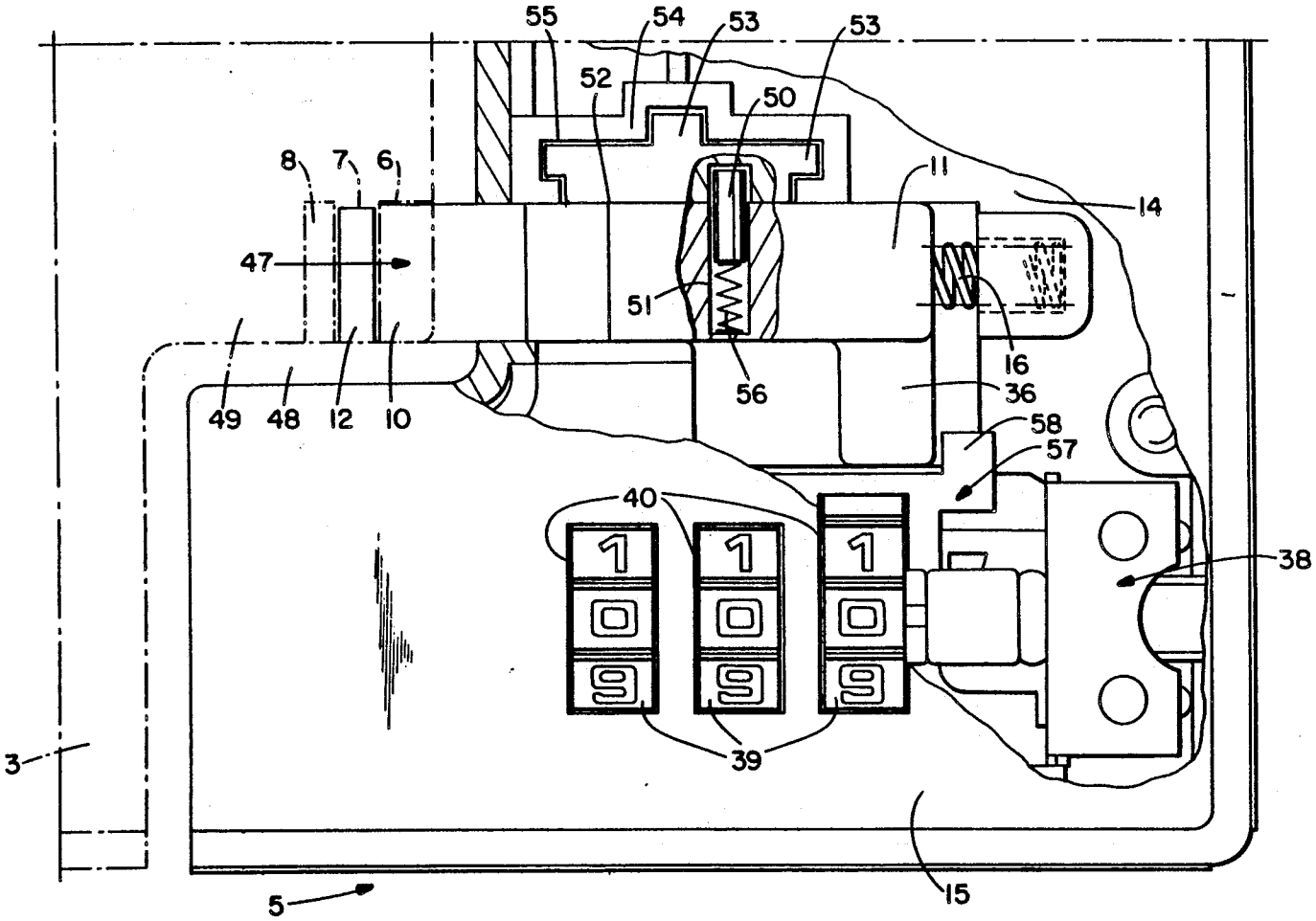
FIG. 11 is a view similar to FIG. 4 of the second embodiment.
Figure 12:
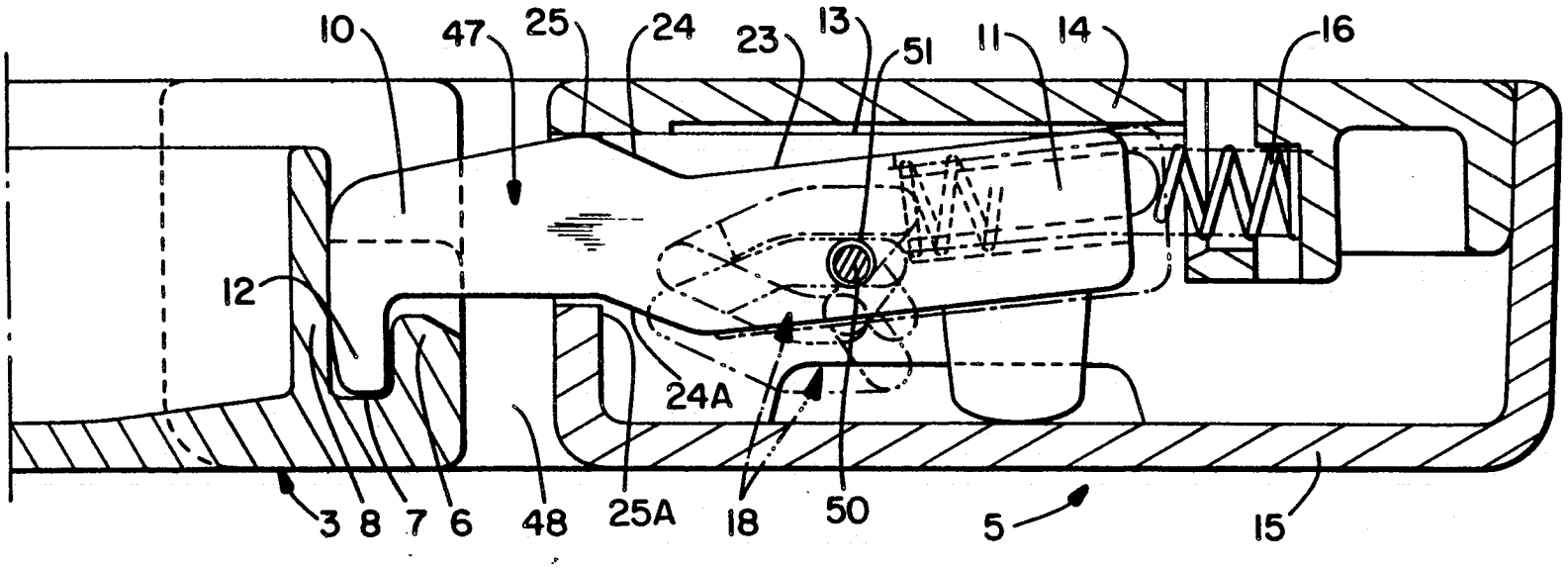
FIG. 12 is a view similar to FIG. 5 of the second embodiment.
Figure 13:
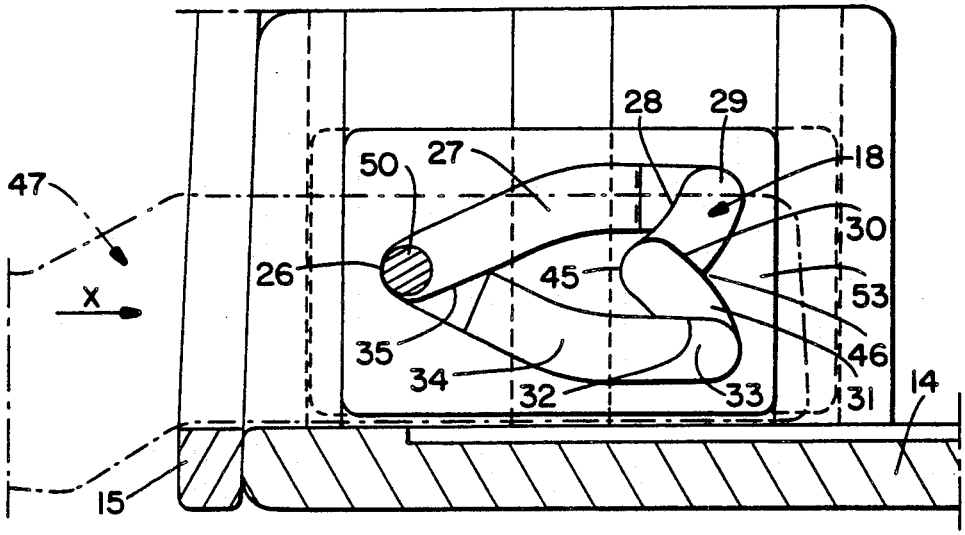
FIG. 13 is a view taken along the line 13—13 in FIG. 9 depicting an endless cam slot when the latching bolt is in a released position.
Figure 14:
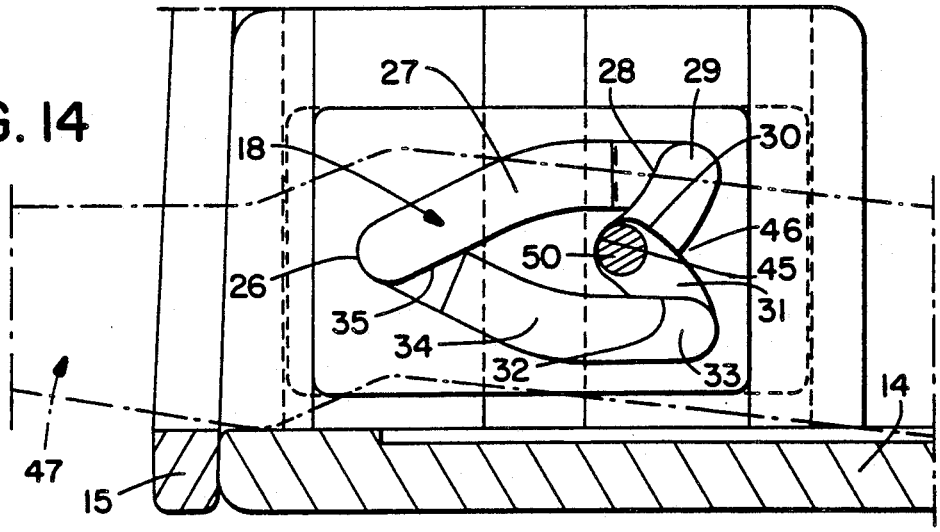
FIG. 14 is a view similar to FIG. 13 when the latching bolt is in a latching position.
Figure 15:
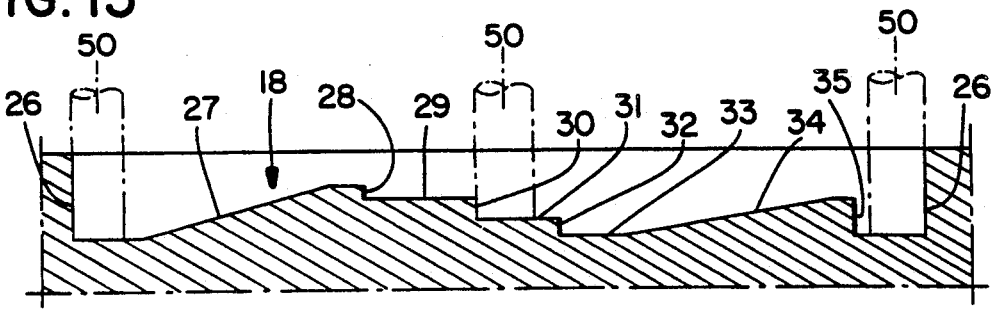
FIG. 15 is a view similar to FIG. 7 of the second embodiment.

If the dials are on-combination, the catch of the locking bolt is then in the release position shown in solid lines in FIG. 6. The latching bolt 9 will have been moved forwardly by the spring 16 to partially open the door 2. Hook 12 is located outside of the path of motion of the projecting catch portion 6 of the counter-locking component 3, whereby the door can be fully opened.

If door 2 is now pushed closed, the tab 8 of the counter-locking component 3 acts upon the rounded head 10 of the latching bolt 9 and displaces the latter rearwardly. At the same time, the latching bolt 9 is caused to be swiveled in response to contact between the surface 25 of the guide groove 13 and the position control slope 24. The hook 12 is thus displaced laterally to enter the recess 7 of the counter-locking component 3. At the same time, the pin 17 will have moved through the upper side section 27 of the cam slot and will have entered the upper half section 29 after having passed down the step 28. By then releasing the door 2, the pressure spring 16 pushes the sliding bolt 9 forwardly until the pin 17 abuts a stop shoulder 45 located at the intersection of the upper and lower half sections 29, 31 of the cam slot. A returning of pin 17 to the forward end of the upper half section 29 is no longer possible due to the presence of the step 30. Thus, the cam slot may be considered as retaining the latching bolt in its latching position.

Figure 5:
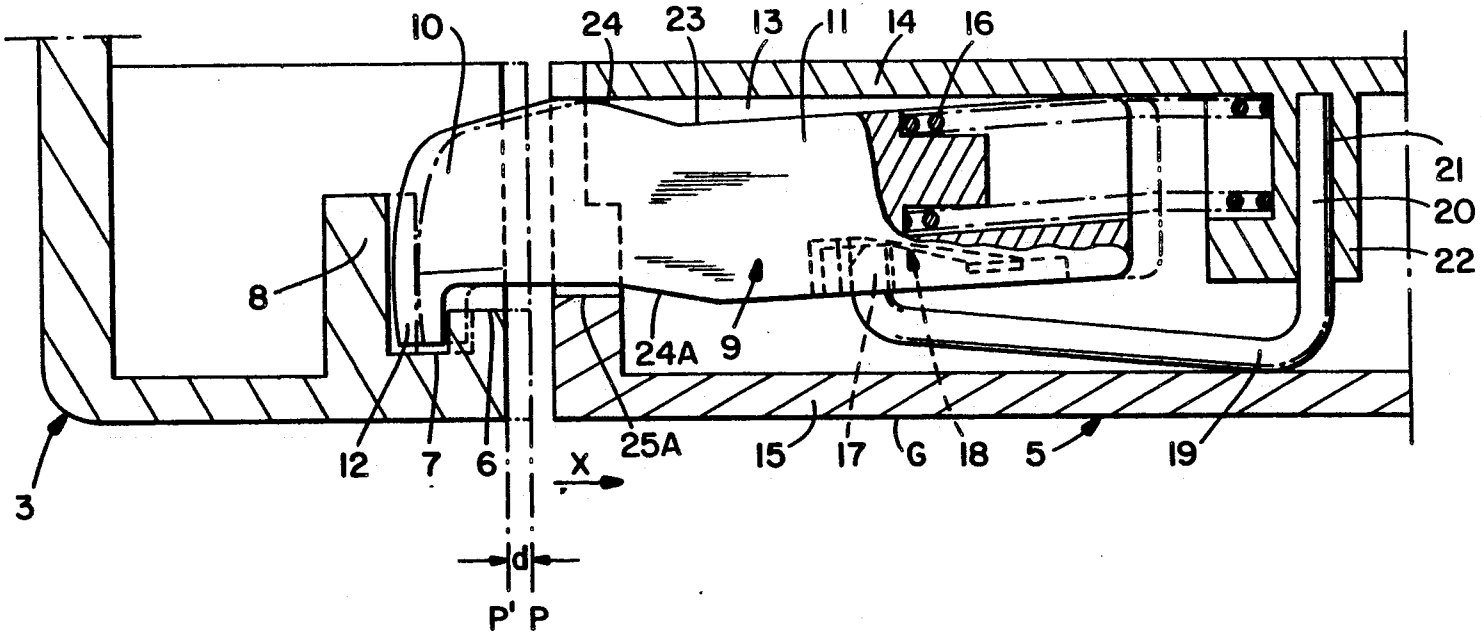
FIG. 5 is a view similar to FIG. 3 depicting the latching bolt in a latching position.
Figure 7:
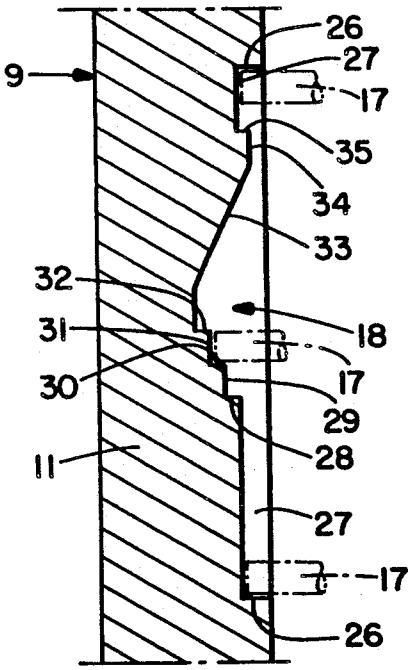
FIG. 7 is a cross-sectional view taken through a portion of the lock housing which contains an endless cam slot.

When the pin 17 was located at the step 28 during the above-described closing movement, the proximate edge of the door was located at position P in FIG. 5. When the pin thereafter became located at the shoulder 45, the proximate edge of the door was located at position P', i.e., the door was moving in the door-opening direction as the pin 17 was traveling in the upper half section 29 of the cam slot. Thus, the door moved slightly forwardly by a distance d and must thereafter move rearwardly by that same distance in order for the pin 17 to reach the corner between the lower half section 31 and the lower side section 33 of the cam slot in order to be able to open the door. During movement toward that corner, the pin 17 will be cammed downwardly slightly by engagement with a gusset 46 which defines some of the walls of the lower half section 31.

As soon as the pin 17 has left the lower half section 31 the step 32 prevents a returning of the pin 17 in the opposite direction. The spring force of the pressure spring 16 is now able to displace the hook-shaped sliding bolt 9 in its release direction and thus triggers the opening motion of door 2, i.e., the spring 16 pushes the door forwardly to initiate the door-opening stage. At this time, the pin 17 moves through the lower side section and returns to the tip 26 after having passed step 35. There it is supported by the tip in the release position.

The latching bolt 9 is swiveled out of the recess 7 by the engagement of a cam surface 24A of the latching bolt with an edge 25A of the opening 13A, and/or by the spring wire 19, and/or by the spring 16.

As a result of the foregoing description, it will be appreciated that in accordance with the present invention, principles under which some ball point pens are actuated have been uniquely applied to enable a cabinet door to be locked and unlocked. Accordingly, the user needs only one hand to lock and unlock the door.

Once the door 2 has been moved to its closing position, it is possible to swivel the catch of the locking bolt 37 simply by changing the combination setting by turning one or more of the setting dials to an off-combination position. This causes the insertion opening 41 to receive the projection 36 of the sliding bolt 9. No dislocation of the door 2 or the sliding bolt 9 is now possible.

A lock according to the present invention is characterized by a simple design and allows for an extremely simple operation. If the door is closed, the latching bolt 9 is engaged with the counter-locking component, preventing an accidental opening of the door. In addition, it is possible to block the latching bolt 9 by means of a separate locking bolt 37 which may be operated by means of a key or a dial. If the locking bolt is not moved to a locking position after the door has been closed, then the opening of the door is possible only after the pin is properly maneuvered within the cam slot. That maneuvering involves displacing the door in its closing direction X. Closing and opening of the door, however, is easily carried out as a one-hand operation, which is particularly important for handicapped users. All that is required to open the door is a further displacement of the door to shift the latching bolt 9 in its closing direction so as to maneuver the pin 17 into the lower side section 33 of the cam slot. Then, the door may be moved in its opening direction without any obstruction. In order to prevent such maneuvering of the pin to release the door is to be avoided, the stop 37 will have to be moved into the path of travel of the latching bolt. A measure to increase the operational convenience is the fact that the cam slot is endless, and the latching bolt is spring biased forwardly. If the door is in its closed position and the latching bolt 9 is displaced so as to be released from the shoulder 45 of the cam slot, the spring 16 is able to automatically push the latching bolt, as well as the door, forwardly. The pin 17 travels one complete path of the endless slot during the opening and closing of the door.

By forming the pin as an angled end piece of a spring wire with a preload in the direction of the cam slot, the pin will be self-biased into the cam slot. This means that the number of components required is reduced and at the same time the design of the lock is simplified combined with a reduction of the manufacturing costs.

The fact that the end of the spring wire opposite to the pin is angled in a way that it is parallel to the pin itself and supported in a locating hole in the lock housing is responsible for a convenient mounting of the spring wire. This allows for a swiveling of the spring wire which in turn ensures a favorable travel of the pin in the cam slot. It is advantageous that the design of the cam slot is a heart shape with the tip thereof pointing rearwardly. While the door is open and the latching bolt is in its release position, the pin is engaged in the tip of the cam slot, whereby any forward displacement of the latching bolt beyond that position is prevented.

The provision of steps in the endless cam slot ensures that the pin can travel in only one direction. In order to ensure that the pin travel is not obstructed, the tail piece of the latching bolt is supported in a guide groove in the lock housing. The latching bolt is equipped with a position control slope adjacent to the tail piece which, together with an edge of the front opening of the guide groove defines a forced guiding system for swiveling the latching bolt. The spring wire is responsible for the back of the locking bolt permanently being pushed against a side of the guide groove.

The tail piece of the latching bolt is equipped with a projection which cooperates with the locking bolt. The locking bolt is controlled by the locking mechanism, which may be designed as a permutation lock. If the permutation lock is off-combination, the projection is blocked, whereby opening of the door is not possible. It is not until the dial setting is on-combination that the locking bolt, designed as a conventional rocker bolt, may swivel out of the path of the projection 36 of the latching bolt. If the locking bolt is designed as a catch bolt, it is possible to close the door, even if the lock is locked. In this case the catch bolt yields in order to engage the latching bolt from behind.

A second embodiment of the present invention is depicted in FIGS. 8–15, in which the same elements as in the first embodiment are provided with the same reference numerals. The second embodiment differs from the first embodiment mainly in that the pin and cam slot are reversed, i.e., the pin is carried on the sliding bolt and the cam slot is carried by the lock housing. The second embodiment makes use of a lock housing equipped with a rectangular recess 48 formed by a protrusion 48A disposed directly below a hook-shaped sliding bolt 47 which protects the sliding bolt head 10 when the door is open. An extension 49 of the counter-locking component 3 fits into the recess 48.

The hook-shaped sliding bolt 47, in contrast to that of the first embodiment, is equipped with a pin 50. This pin is located in a transverse pocket 51 of the tail piece 11. This pocket 51 extends perpendicularly to the shifting direction of the hook-shaped sliding bolt 47 and intersects an end of the lateral flank 52 of the hook-shaped sliding bolt opposite the permutation lock 38. A pressure spring 56 rests against the bottom of the pocket 51 and applies an outward load to the pin 50. The free end of the pin engages in a continuous cam slot 18 which operates under principles similar to those of the first embodiment. The continuous cam slot 18 is located in a floating plate 53 adjacent to the tail piece, the plate being displaceable in a transverse direction with respect to the direction of displacement of the latching bolt during a latching/unlatching operation, as will be explained. The plate 53 is designed as a cartridge to be inserted in housing G in a direction perpendicular to the plane of the paper in FIG. 9. For this purpose a guide protrusion 54 is disposed at the base plate 14, and is equipped with a guide recess 55 which accommodates plate 53 in such a way that a side of this plate 53 slides relative to the guide along a lateral flank 52 of the sliding bolt 47. The heart-shaped continuous cam slot 18, in contrast to that of the first embodiment, is reversed in that the tip of the heart 26 points forwardly, i.e., opposite the direction of insertion X of the hook-shaped sliding bolt. Such reversal is necessitated by the fact that the pin 50 is carried by the latching bolt in this embodiment. When the door is open, the pin 50 is located at the tip 26 of the continuous cam slot 18. The guide 55 also forms part of the guide groove for the latching bolt. This facilitates the assembly of components due to the fact that it is possible to install the hook-shaped sliding bolt 47 as a unit with the plate 53, namely with the spring loaded pin 50 and with the pressure spring 16. A protrusion 36 disposed at the tail piece 11 cooperates with the catch of the locking bolt 57, the latter having been slightly modified relative to that of the first embodiment in that a stop 58 is located on its rear end. Apart from these differences the catch of the locking bolt 57 and the permutation lock mechanism correspond to that of the first embodiment.

If the door 2 is being closed while the catch of the locking bolt 57 is in its release position, i.e., the dials 39 are on-combination, the counter-locking component 3 acts upon the latching bolt head 10 of the hook-shaped sliding bolt 47 and shifts it rearwardly. The hook-shaped sliding bolt 47 is swiveled by contact between the bottom 25 of the guide groove 13 and the position control slope 24, whereby the hook 12 enters the recess 7. In so doing, the pin 50 travels through the first side section 27 of the heart, passes step 28 and then enters the first half section 29 of the head of the heart. During this motion, the plate 53 is shifted by the pin 50 in a direction transversely of the direction of closing X of the latching bolt (i.e., the plate 53 shifts perpendicularly to the paper in FIG. 9). When the operator then releases the door 2, the pressure spring 16 pushes the latching bolt 47 forwardly, so that the pin 50 moves through the first half section 29 of the head of the heart and passes step 30. Thus, the pin 50 reaches the second half section 31 of the head of the heart and is supported there by the center shoulder 45 (see FIG. 14). In this position, the plate 53 remains in a shifted position relative to its position when the pin 50 was disposed at the tip 26, as is apparent from comparing FIGS. 13 and 14. This defines the latching position of the hook-shaped latching bolt 47; the latching bolt head 10 is engaged in the recess 7 of the counter-locking component 3 which means that the door 2 may not be opened. However, there is still sufficient clearance to permit the component 3 to move rearwardly toward the lock 5 (see FIG. 12).

The combination setting may now be changed by turning the setting dials off-combination, so that the locking bolt 57 swivels and its stop 58 moves behind the protrusion 36. This means that it is not possible to move the door in its closing direction X in order to release the latching bolt 47. In order for the door to be opened, the combination setting must be adjusted to an on-combination setting so that the catch of the locking bolt 57 can swivel to its release position. Then, the door 2 may be moved in its closing direction X. If this is done, pin 50 moves through the second half section 31 of the heart and, after having passed the step 32, reaches the initial section 33 of the second side section 34. Pressure spring 16 may now move the hook-shaped latching bolt 47 forwardly in its release direction to partially open the door 2. As this takes place, the pin 50, which is constantly biased into the cam slot 18, travels through the inclined second side section 34 of the heart in order to return to the tip 26 of the heart after having passed step 35. It is also during this motion of the hook-shaped latching bolt 47 and pin 50 that a further shifting of the plate 53 to its original position in the guide 55 takes place.

This second embodiment of the invention is characterized by a high degree of operational efficiency. In addition, the assembly of the lock is simplified considerably due to this particular design. It is also conceivable to design the first half section of the head of the heart shorter than the second half section to allow for a closing of the door even if the locking bolt is in its locking position. Further advantages with respect to the assembly of the lock exist because the plate is a cartridge type component of the housing and can be installed into the housing as a unit with the latching bolt.

Although the present invention has been described in connection with preferred embodiments thereof, it will be appreciated by those skilled in the art that additions, modifications, substitutions, and deletions not specifically described may be made without departing from the spirit and scope of the invention as defined in the appended claims.

What is claimed is:

1. A lock for a closeable member comprising first and second relatively movable elements, said lock comprising a lock component adapted to be mounted to one of said elements, and a counter-locking component adapted to be connected to the other of said elements, said lock component comprising:

a housing having an opening;

a latching bolt slidably mounted in said opening, said latching bolt including a rear end disposed in said housing and a hook-shaped front end disposable outside of said housing, said latching bolt being slidable rearwardly by said counterlocking component to a latching position in response to the closing of said other element wherein said hook-shaped end is placed in latching engagement with said counter-locking component, said latching bolt also being slidable forwardly to an unlatching position;

means for swiveling said latching bolt in one direction during rearward sliding movement thereof to effect said latching engagement;

means for swiveling said latching bolt in an opposite direction during forward sliding movement thereof to effect said unlatching; and a locking bolt for releasably engaging said latching bolt in said latching position.

2. A lock according to claim 1, wherein said means for swiveling said latching bolt in said one direction comprises a front edge of said opening which engages an inclined surface of said latching bolt.

3. A lock according to claim 1, wherein said locking bolt comprises part of a permutation locking mechanism.

4. A lock according to claim 3, wherein said locking bolt comprises a rocker bolt arranged for swiveling motion.

5. A lock according to claim 1 including retaining means for preventing forward movement of said latching bolt out of said latching position, said latching bolt being releasable from said retaining means in response to rearward movement of said latching bolt.

6. A lock according to claim 5, wherein said locking bolt is arranged to prevent said rearward movement of said latching bolt for release from said retaining means.

7. A lock according to claim 5 including a biasing spring for biasing said latching bolt forwardly so that upon release of said locking bolt and said retaining means, said biasing spring displaces said latching bolt forwardly to initiate an opening of said other element.

8. A lock according to claim 5, wherein said retaining means comprises an endless cam slot carried by one of said latching bolt and said housing, and a pin carried by the other of said latching bolt and said housing, an end of said pin being received in said cam slot.

9. A lock according to claim 8, wherein the one of said cam slot and pin which is carried by said latching bolt is disposed in a portion of said latching bolt located in said housing.

10. A latch according to claim 8, wherein said pin is carried by said housing and said cam slot is carried by said latching bolt.

11. A lock according to claim 10, wherein said pin comprises a part of a spring wire which biases said pin into said cam slot.

12. A lock according to claim 11, wherein said spring wire is generally U-shaped and includes an end piece mounted in said housing.

13. A lock according to claim 8, wherein said cam slot is generally heart-shaped.

14. A lock according to claim 13, wherein a tip of said heart shape points rearwardly.

15. A lock according to claim 13, wherein a tip of said heart shape points forwardly.

16. A lock according to claim 13, wherein said heart shape includes a tip, a first side section extending away from said tip to a first juncture with an end of a first half section, said first half section extending toward but short of said tip to a second juncture with an end of a second half section, said second half section extending away from said tip to a third juncture with an end of a second side section, said second side section extending to said tip and forming a fourth juncture therewith, said first, second, third and fourth junctures including steps arranged to ensure that relative movement between said cam slot and said pin occurs only in one direction.

17. A lock according to claim 8, wherein said pin is carried by said latching bolt and said cam slot is carried by said housing.

18. A lock according to claim 17, wherein said pin is spring biased into said cam slot.

19. A lock according to claim 17, wherein said cam slot is disposed in a plate which is freely slidable in a direction transversely of the front-to-rear direction of sliding movement of said latching bolt.

20. A lock according to claim 19, wherein said housing is arranged such that said plate and said latching bolt can be installed as a unit into said housing, with said pin disposed in said cam slot.

21. A lock according to claim 1, wherein said latching bolt includes a projection adjacent its rear end, and said locking bolt includes a protrusion for engaging said projection.

22. A lock according to claim 1 including a biasing spring for biasing said latching bolt forwardly.

23. A lock for a closable member comprising first and second relatively movable elements, said lock comprising a lock component adapted to be mounted to one of said elements, and a counter-locking component adapted to be connected to the other of said elements, said lock component comprising:

a housing having an opening;

a rigid one-piece latching bolt slidably mounted in said opening, said latching bolt including a rear end disposed in said housing and a hook-shaped front end disposable outside of said housing, said latching bolt being slidable rearwardly by said counter-locking component to a latching position in response to the closing of said other element, wherein said hook-shaped end is placed in latching engagement with said counter-locking component, said latching bolt also being slidable forwardly to an unlatching position;

means for swiveling the entire latching bolt to move said front end in one direction during rearward sliding movement thereof to effect said latching engagement;

means for swiveling the entire locking bolt to move said front end in an opposite direction during forward sliding movement thereof to effect said unlatching; and retaining means for preventing forward movement of said latching bolt out of said latching position, said latching bolt being releasable from said retaining means in response to rearward movement of said latching bolt.

24. A lock according to claim 23, wherein said retaining means comprises an endless cam slot carried by one of said latching bolt and said housing and a pin carried by the other of said latching bolt and said housing, an end of said pin being received in said cam slot.

25. A lock according to claim 23 including a biasing spring for biasing said locking bolt forwardly so that upon release of said locking bolt and said retaining means, said biasing spring displaces said latching bolt forwardly to initiate an opening of said other element.

26. A lock for a closable member comprising first and second relatively movable elements, said lock comprising a lock component adapted to be mounted to one of said elements, and a counter-locking component adapted to be connected to the other of said elements, said lock component comprising:

a housing having an opening;

a latching bolt slidably mounted in said opening, said latching bolt including a rear end disposed in said housing and a hook-shaped front end disposable outside of said housing, said latching bolt being slidable rearwardly by said counter-locking component to a latching position in response to the closing of said other element, wherein said hook-shaped end is placed in latching engagement with said counter-locking component, said latching bolt also being slidable forwardly to an unlatching position;

means for swiveling said latching bolt in one direction during rearward sliding movement thereof to effect said latching engagement;

means for swiveling said locking bolt in an opposite direction during forward sliding movement thereof to effect said unlatching; and retaining means for preventing forward movement of said latching bolt out of said latching position, said latching bolt being releasable from said retaining means in response to rearward movement of said latching bolt;

wherein said retaining means comprises an endless cam slot carried by one of said latching bolt and said housing and a pin carried by the other of said latching bolt and said housing, an end of said pin being received in said cam slot; and wherein said pin is carried by said latching bolt and said cam slot is carried by said housing, said cam slot being disposed in a plate which is freely slidable in a direction transversely of the front-to-rear direction of sliding of said latching bolt.

* * * * *

UNITED STATES PATENT AND TRADEMARK OFFICE

CERTIFICATE OF CORRECTION

PATENT NO. : 4,991,416

DATED : February 12, 1991

INVENTOR(S) : Henry Resendez and Helmut Klein

It is certified that error appears in the above-identified patent and that said Letters Patent is hereby corrected as shown below:

ON THE TITLE PAGE: Foreign Priority should read;

--[30] Foreign Application Priority Data
Oct. 26, 1988 [DE] Germany ..... 38 36 383
Aug. 31, 1989 [DE] Germany ..... 39 15 362 --

Signed and Sealed this

Twelfth Day of January, 1993

*Attest:*

DOUGLAS B. COMER

*Attesting Officer*

*Acting Commissioner of Patents and Trademarks*